United States Patent [19]

Pitchford

[11] 4,112,854

[45] Sep. 12, 1978

[54] METAL PALLET

[76] Inventor: Peter R. Pitchford, 188 Grenadier Rd., Toronto, Ontario, Canada, M6R 1R7

[21] Appl. No.: 840,435

[22] Filed: Oct. 7, 1977

[51] Int. Cl.[2] ..... B65D 19/28

[52] U.S. Cl. ..... 108/56.1; 52/667; 108/51.1; 403/347

[58] Field of Search ..... 108/56.1, 51.1, 51.3, 108/54.1, 57.1; 52/485, 664, 667–669, 579, 588, 629, 473; 403/346, 347, 353

[56] References Cited

U.S. PATENT DOCUMENTS

| | | | |
|---|---|---|---|
| 1,027,641 | 5/1912 | Collins | 403/347 |
| 2,657,437 | 11/1953 | Moser | 52/473 |
| 3,540,178 | 11/1970 | Altissimo | 52/669 |
| 3,602,157 | 8/1971 | Cohen et al. | 108/51.1 |
| 3,861,108 | 1/1975 | Hartman | 52/667 |
| 4,062,301 | 12/1977 | Pitchford | 108/54.1 X |

*Primary Examiner*—Roy D. Frazier
*Assistant Examiner*—William E. Lyddane
*Attorney, Agent, or Firm*—Moss, Bensette

[57] ABSTRACT

An improved metal pallet is shown having elongate deck members defining a load bearing surface and transverse stringer members to support the deck members. The stringer members are generally U-shaped having generally upright laterally resilient sides defining longitudinally spaced-apart, transverse openings located adjacent to the upper marginal edges of the sides. The ends of the deck members pass through the stringer member openings. The deck members have longitudinal downwardly and outwardly disposed laterally resilient sides defining opposed pairs of parallel slot openings. The longitudinal spacing between these slot openings is different than the normal transverse spacing between the stringer sides, so that upon assembly of the pallet the stringer and deck member sides are laterally deflected; the peripheral edges of the stringer openings are located in the slot openings, and the deck members and stringer member are biased into mutual engagement by the lateral deflections of the respective sides.

14 Claims, 8 Drawing Figures

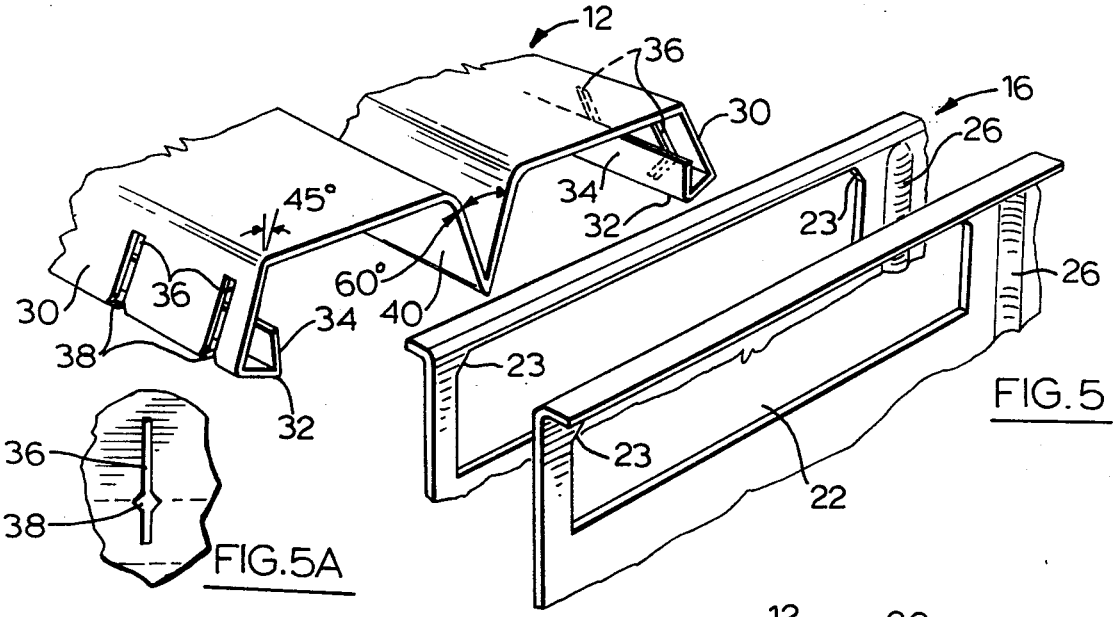
FIG. 5
FIG. 5A
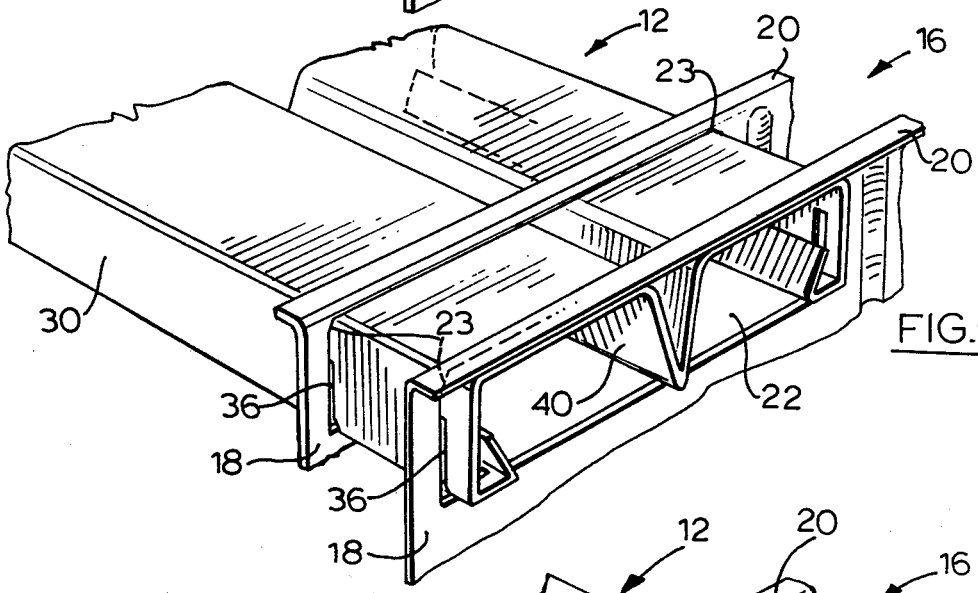
FIG. 6
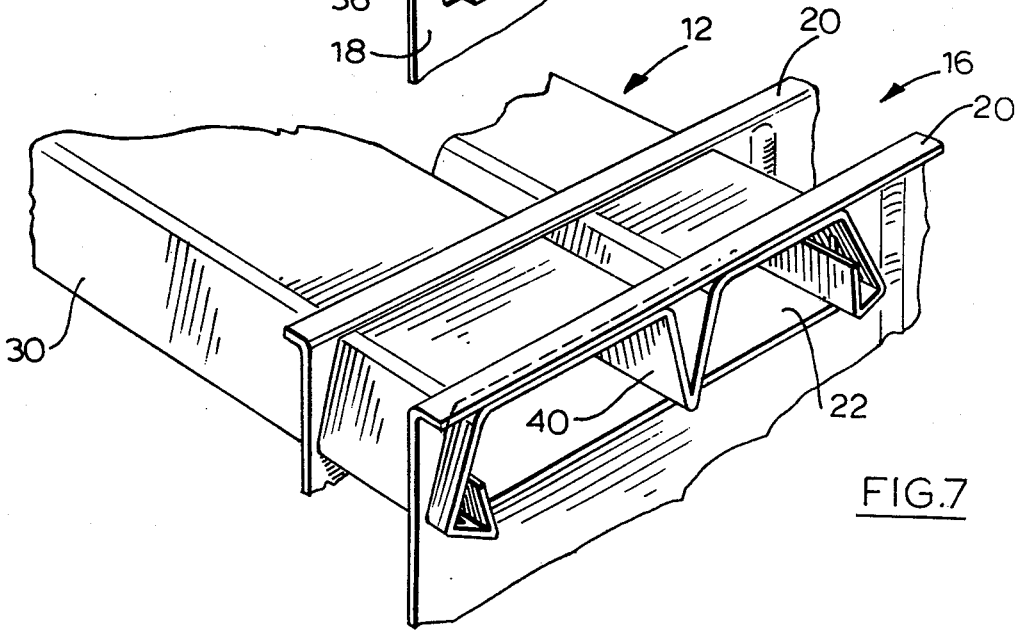
FIG. 7

METAL PALLET

This invention relates to metal pallets, such as are used in material handling and warehousing operations where various loads are supported or loaded onto the pallet to facilitate handling of the loads.

In the past, probably the most frequently used material for the construction of material handling pallets has been wood. Wooden pallets have been made in practically all sizes and shapes, and have been used for transporting practically any type of item that could be loaded thereon. A difficulty with wooden pallets, however, is that they have a rather short life expectancy as a result of frequent damage to the various structural members. These pallets can often be repaired, but the cost of repairs is often too high to be economically worthwhile.

In order to extend the life and increase the durability of pallets, it has been proposed to make the pallets out of steel, or other metals. Such pallets have been made in the past using tubular steel structural members, and generally these pallets have been very durable in use. However, in view of the extreme abuse that a pallet usually takes in use, not only by high static loading, but primarily through mishandling and excessive forces during the movement or transporting of the loads, most steel pallets in the past have been made very heavy to withstand the wear and tear to which they are normally subjected. Further, to make these steel pallets sufficiently strong, it has often been necessary to use welded construction or to connect the members together using rivets or threaded fasteners. As a result, the steel pallets produced in the past have been heavy and expensive to construct and repair.

The metal pallet of the present invention is constructed of relatively light deck and stringer members that require no additional fastening means to assemble the pallet, and yet the pallet is extremely strong due to the biased interaction of the deck and stringer members.

According to one aspect of the present invention, there is provided in a pallet having coplanar adjacent deck members defining a load bearing surface, and a plurality of transverse stringer members supporting the deck members, an improvement comprising: a pair of parallel spaced-apart, generally U-shaped stringer members having generally upright laterally resilient sides defining longitudinally spaced-apart, transverse openings located adjacent to the upper marginal edges of the sides. A plurality of coplanar, parallel, laterally spaced-apart elongate deck members are provided having longitudinal, downwardly and outwardly disposed, laterally resilient sides, the ends of the deck members being adapted to pass through the stringer openings upon lateral inward deflection of the deck member sides. Also, the deck member sides define opposed pairs of parallel slot openings located adjacent to the deck member ends, the longitudinal spacing between the slot openings being different than the normal transverse spacing between the stringer sides, so that upon assembly of the pallet, the stringer and deck member sides are laterally deflected, the peripheral edges of the stringer openings are located in the slot openings, and the deck members and the stringer members are biased into mutual engagement.

A preferred embodiment of the invention will now be described, by way of example, with reference to the accompanying drawings, in which:

FIG. 5A is an enlarged view of a portion of the blank of FIG. 3 showing a typical slot opening;

FIGS. 5, 6 and 7 are enlarged views of a corner of the pallet shown in FIG. 1, illustrating the insertion of the end of a deck member into a stringer member during assembly of the pallet.

Figure 2:
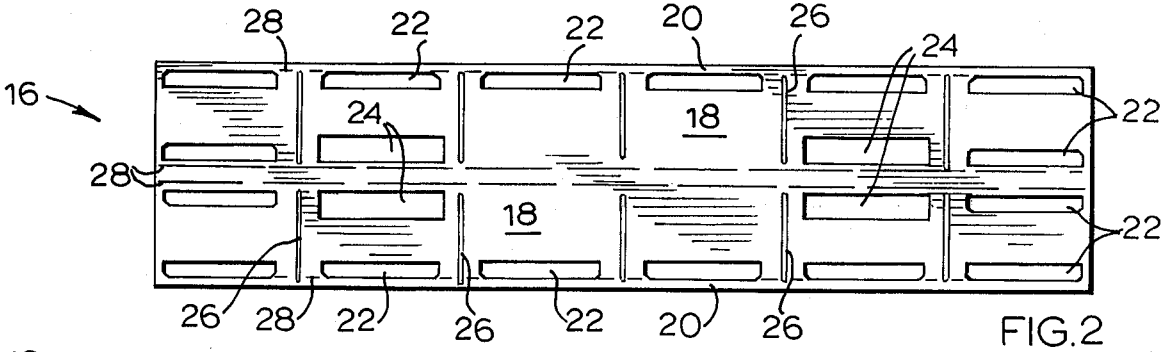
FIG. 2 is a plan view of a blank used to form the stringer members of the pallet shown in FIG. 1.
Figure 1:
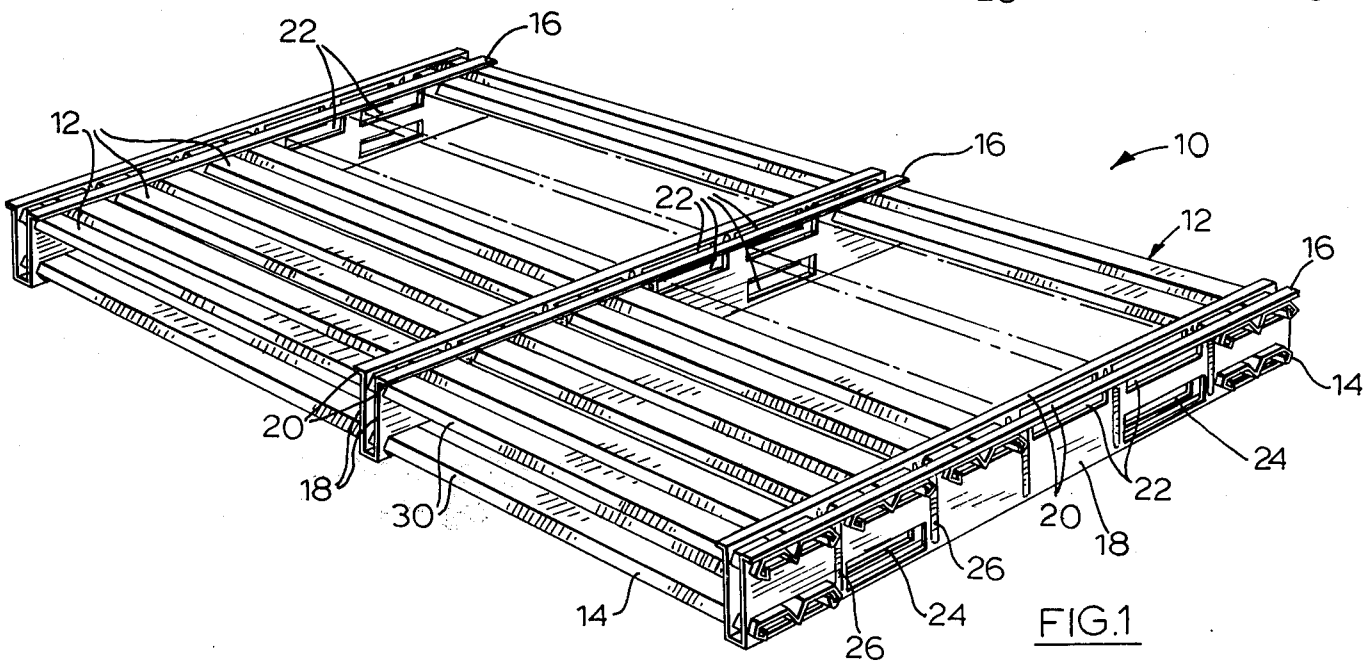
FIG. 1 is a perspective view of a preferred embodiment of an improved metal pallet according to the present invention.
Figure 3:
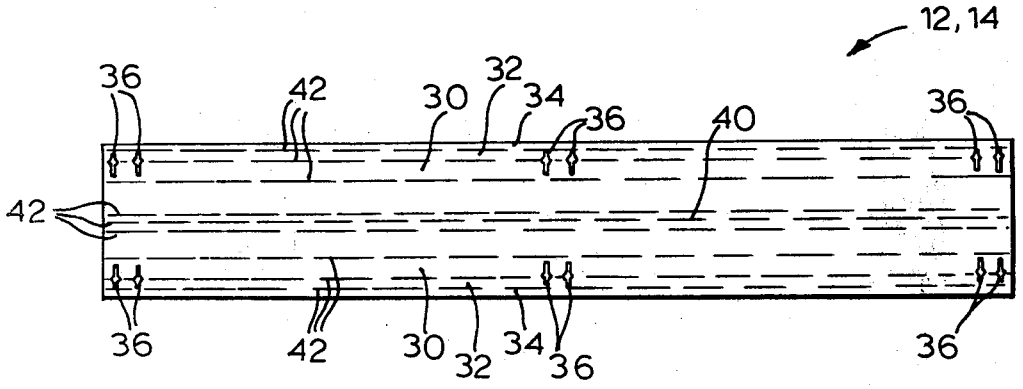
FIG. 3 is a plan view of a blank used to form the deck members of the pallet shown in FIG. 1.

Referring firstly to FIGS. 1 to 3, a preferred embodiment of a metal pallet according to the present invention is generally indicated in FIG. 1 by reference numeral 10. Pallet 10 includes a plurality of coplanar, adjacent deck members 12 defining a load bearing surface, and a pair of lower deck members 14 spaced along each side of pallet 10. Deck members 12, 14 are identical. Pallet 10 also includes three transverse stringer members 16 which support the deck members. In FIG. 1, some of the deck members 12 have been omitted for the purpose of illustration.

Figure 4:
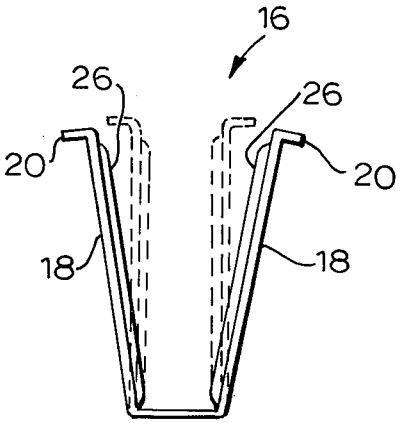
FIG. 4 is an end view of a stringer member showing the stringer member in its normal state in solid lines and in its transversely or laterally deflected state in dotted lines.

Stringer members 16 are generally U-shaped in cross-section having generally upright sides 18 and transverse, elongate upper marginal flanges 20 (see also FIG. 4). Stringer sides 18 define longitudinally spaced-apart, transverse openings 22 located adjacent to upper marginal flanges 20. As seen in FIG. 1, deck members 12 pass through transverse openings 22 for mutual engagement of the deck and stringer members, as will be described further below.

The stringer member sides 18 also define pairs of transverse, four-way entry openings 24 located adjacent to the bottom of the stringer members for insertion of forks of a fork-lift truck, where it is desired to lift pallet 10 from the ends, rather than the sides. In the latter case, the forks of the fork-lift truck would be inserted between upper and lower deck members 12, 14, the pallet 10 then being lifted from the side. Stringer member sides 18 are also formed with a plurality of stiffening ribs 26 located between adjacent transverse openings 22. Stiffening ribs 26 are inwardly facing, vertically orientated depressions formed in stringer sides 18, and are included in stringer members 16 to resist lateral side sway of the stringer members when loaded.

Referring in particular to FIGS. 2 and 4, stringer members 16 are formed from 16 gauge sheet galvanized steel. Manufacture of the stringer members begins with a blank as shown in FIG. 2 wherein transverse openings 22 and four-way entry openings 24 have been punched out of the blank. It will be noted that transverse openings 22 have upper bevelled corners 23 (see FIG. 5), the purpose of which is discussed below. Stiffening ribs 26 are also formed in the blank in any conventional manner. The blank is then bent along the dotted bend lines 28 shown in FIG. 2, until the stringer member is in the generally U-shaped configuration as shown in solid lines in FIG. 4. It will be appreciated that the punching, metal forming and bending operations required to manufacture stringer members 16 may be executed in various different ways or sequences, but the exact method of producing stringer member 16 is not considered to be part of the present invention.

Referring next to FIGS. 1, 3 and 5, deck members 12 will now be described in detail. Lower deck members 14 are identical to deck members 12 and therefore the description of deck members 12 will also apply to lower deck members 14. Deck members 12 are formed with downwardly and outwardly disposed, laterally resilient sides 30 which include longitudinal, generally V-shaped reinforcing portions 32. The inner or marginal leg 34 of reinforcing portions 32 is generally upright when the pallet is assembled. The reason for this is that where the pallet is lifted from the side, the forks of the fork-lift truck bear against the underside of the deck members, and the upright marginal legs 34 produce maximum strength for the vertical lifting forces applied thereto. Deck member sides 30 are downwardly and outwardly disposed at an angle of approximately 45° as indicated in FIG. 5 when the deck members are in the normal or undeflected state.

The deck member sides 30 are formed with opposed pairs of parallel slot openings 36 located adjacent to the ends of the deck members, and also midway between the ends of the deck members (see FIG. 3). Slot openings 36 are formed partially in the downwardly and outwardly disposed portion of deck member sides 30 and partially in the V-shaped reinforcing portions 32. Slot openings 36 are also formed with enlarged lead-in openings 38 (see FIGS. 5 and 5A) to facilitate engagement of the deck members and stringer member sides on assembly of the pallet, as will be described further below.

Deck members 12, 14 are also formed with central, longitudinal, generally V-shaped strengthening ribs 40. Strengthening ribs 40 include an angle of approximately 60° as indicated in FIG. 5 when the deck members are in the normal or undeflected state. Ribs 40 extend downwardly to engage the lower peripheral edges of stringer member transverse openings 22. Since the top surfaces of deck members 12 engage the upper peripheral edges of the stringer member transverse openings 22, and since ribs 40 engage the lower peripheral edges of transverse openings 22, strengthening ribs 40 transmit a substantial portion of the lateral forces or load on the deck members to the stringer members.

Referring in particular to FIG. 3, deck members 12, 14 are formed from a blank of 22 gauge galvanized sheet steel. As in the case of stringer members 16, slot openings 36 are punched out of the blank and the blank is bent along bend lines 42 into the configuration shown in FIG. 5. As seen best in FIGS. 6 and 7, the pairs of slot openings 36 located adjacent to the ends of the deck members are spaced from the ends of the deck members a distance equal to the width of the stringer member upper marginal flanges 20, so that the deck member ends do not project beyond the stringer member flanges. In other words, the outer stringer member flanges 20 are flush with the ends of the deck members. This ensures that the ends of the deck members will not form projections to catch on adjacent objects during movement of pallet 10. This is particularly important where pallet 10 travels on conveyors or in other confined spaces.

Referring next to FIGS. 4 to 7, the assembly of pallet 10 will now be described. Although the following description is more appropriate to manual assembly of the pallet, it will be apparent to those skilled in the art that a jig or fixture could be used to facilitate assembly. In any event, a stringer member 16 is first laterally inwardly deflected until the stringer sides 16 are approximately parallel, as shown in dotted lines in FIG. 4. As shown in FIGS. 5 to 7, the stringer member is held in this position, the deck member sides 30 are then laterally inwardly deflected (see FIG. 6), and the deck member is slid through stringer member transverse openings 22, until slot openings 36 are in registration with stringer sides 18 or the adjacent peripheral edges of stringer transverse openings 22. Deck member sides 30 are then released and the peripheral edges of stringer transverse openings 22 enter and are located in slot openings 36 (see FIG. 7). In practice, once the deck member sides 30 have been laterally inwardly deflected and the deck member has been slid partially into a stringer transverse opening 22, the deck member sides 30 may be released, and the deck member may be slid further through transverse opening 22 until slot openings 36 align with stringer sides 18, at which time the deck member sides will snap outwardly and lock into position. To facilitate this alignment and snapping into position, the slot openings 36 have lead-in openings 38, as discussed above. These lead-in openings obviate the necessity for accurate alignment of the stringer member sides 18 and also permit fairly wide dimensional tolerances for the deck and stringer members.

It will be noted from FIG. 6 that the sides of strengthening ribs 40 are also laterally inwardly deflected as the deck member sides 30 are inwardly deflected, so that ribs 40 include an angle somewhat less than 60° as shown in FIG. 5. This causes the deck members to tend to laterally expand as the deck member sides snap outwardly and lock into position. This tendency for outward expansion of the deck members helps the deck members to fit tightly or snugly in the stringer members. In addition, as mentioned above, transverse openings 22 have upper bevelled corners 23 which also help to make the deck members fit tightly. These bevelled corners tend to centre the deck members in transverse openings 22 and absorb any dimensional tolerance variations in the width of the deck members. The bevelled corners also help reduce sheer stress concentrations when the pallet is lifted by fork-lift truck forks inserted under the deck members.

It will be appreciated that in view of the inherent resilience of the sheet metal used for stringer members 16, that the stringer member sides 18 are biased laterally outwardly. The longitudinal spacing between each slot opening 36 of a pair of slot openings 36 is less than the normal transverse or lateral spacing between stringer sides 18 to ensure that the stringer member sides are biased transversely outwardly into engagement with the deck members. Also, the horizontal width of the stringer transverse openings 22 is slightly less than the transverse or lateral distance between slot openings 36, so that the inherent resilience of the steel deck member sides 30 and strengthening ribs 40 results in these deck member sides being biased outwardly into engagement with the peripheral edges of the stringer transverse openings 22. The result is that the deck members and stringer members are biased into mutual engagement to produce a very rigid and tight fitting connection between the respective members.

It will be appreciated that each deck member 12 and each lower deck member 14 may be inserted and engaged with stringer member 16 as described above. Once all of the ends of the deck members 12, 14 are engaged with a respective stringer member, a second stringer member may be slid over the opposite free ends of the deck members in a similar manner. To assemble the centre stringer member 16, it is only necessary to inwardly deflect the deck member sides 30 until the stringer member 16 is slid along the deck member past the slot openings 36 adjacent to the ends of the deck members. The centre stringer member 16 would then snap into position when the sides of the stringer member are in alignment with the central slot openings 36 in the deck members. It will be appreciated that the stringer members and deck members may be assembled in a different sequence than described above, and that all deck members and stringer members may be assembled simultaneously using an appropriate jig or fixture.

Figure 8:
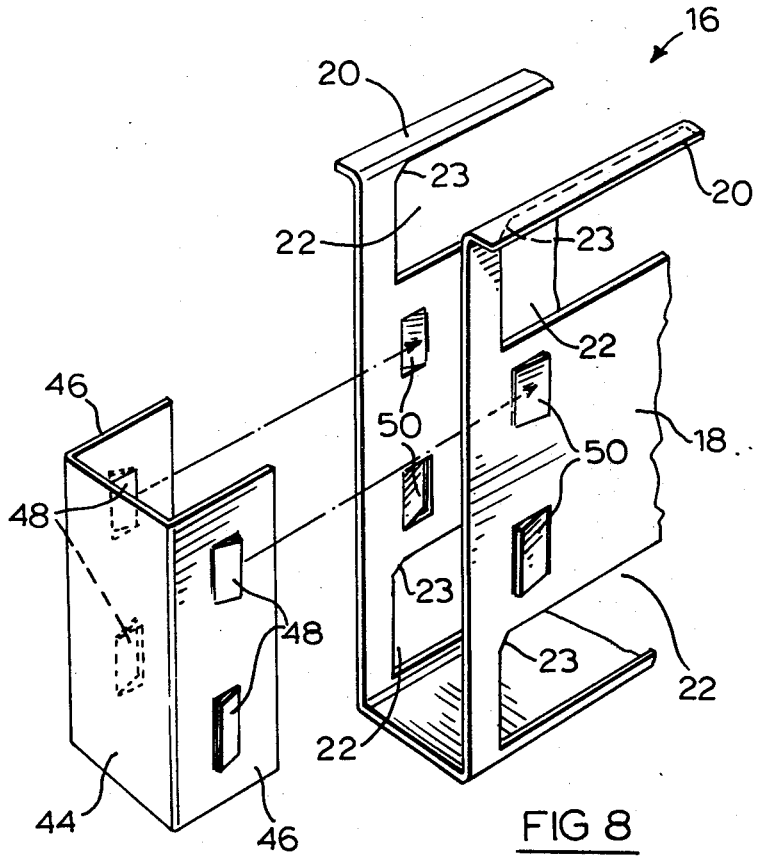
FIG. 8 is a perspective view of a plug used to cap the open ends of the stringer members.

Referring finally to FIG. 8, a modification to the ends of the stringer members 16 is illustrated. In this embodiment, a U-shaped plug 44 having generally parallel upright sides 46 is used to cap the open ends of the stringer members, and thus strengthen the stringer member ends and protect same against damage caused by careless entry of forks of a fork-lift truck. Plug sides 46 are formed with partially punched out tabs 48, and the ends of stringer members 16 are formed with partially punched out tabs 50. When plug 48 is slid into the end of stringer member 16 with plug sides 46 inside stringer sides 18, the respective tabs 48, 50 meet or engage to prevent the plug from being inserted too far or from being inadvertently removed from the stringer member. It will be apparent that tabs 48, 50 are reversely orientated from top to bottom to prevent rotational movement of plug 44. It will also be apparent that plug 44 may be removed by inward deflection of tabs 48, if desired.

Having described preferred embodiments of the invention, it will be appreciated that various modifications may be made to the structure described. For example, the longitudinal spacing between the pairs of deck member slot openings 36 could be greater than the undeflected width or lateral distance between stringer sides 16, so that the stringer sides would be deflected outwardly (rather than inwardly) to produce the two-way or mutual engagement of the stringer and deck members.

It is also not necessary to laterally inwardly deflect the sides of strengthening ribs 40 during assembly of the pallet, as indicated in FIG. 6. The deck and stringer members will still be biased into mutual engagement to produce tight fits therebetween. Also, the bevelled corners 23 in transverse openings 22 may be eliminated if desired.

It will be apparent that pallet 10 may be made in any convenient size, and that different numbers of deck members and stringer members may be used if desired. The centre stringer members 16 and lower deck members 14 may be eliminated if desired, especially for smaller size pallets or where the pallets are required to support only light loads. Typical sizes of pallet 10 range from 36 inches to 60 inches in length or width or vice versa. The height or thickness of pallet 10 is typically about 5¼ inches.

The metal pallet of the present invention is simple to assemble, and yet is extremely strong due to the biased interengagement of the deck and stringer members. It will be appreciated that the engagement of the deck members along the upper marginal edges of the sides of the U-shaped stringer members results in effective tubular construction for the stringer members, because the deck members close the opening of the U-shaped stringer members. This, coupled with the stringer stiffening ribs results in a pallet which is very resistant to lateral side sway. Finally, the pallet may be assembled or disassembled without the use of any additional fastening means.

What I claim is:

1. In a pallet having coplanar, adjacent deck members defining a load bearing surface, and a plurality of transverse stringer members supporting the deck members, the improvement comprising: a pair of parallel spaced-apart, generally U-shaped stringer members having generally upright, laterally resilient sides defining longitudinally spaced-apart, transverse openings located adjacent to the upper marginal edges of the sides; a plurality of coplanar, parallel, laterally spaced-apart, elongate deck members having longitudinal, downwardly and outwardly disposed, laterally resilient sides, the ends of the deck members being adapted to pass through said stringer openings upon lateral inward deflection of said deck member sides; and the deck member sides defining opposed pairs of parallel slot openings located adjacent to the deck member ends, the longitudinal spacing between said slot openings being different than the normal transverse spacing between the stringer sides, so that upon assembly of the pallet, the stringer and deck member sides are laterally deflected, the peripheral edges of said stringer openings are located in said slot openings, and the deck members and stringer members are biased into mutual engagement.

2. A pallet as claimed in claim 1 wherein the longitudinal spacing between said slot openings is less than the normal transverse spacing between the stringer sides.

3. A pallet as claimed in claim 1 wherein the longitudinal spacing between said slot openings is greater than the normal transverse spacing between the stringer sides.

4. A pallet as claimed in claim 2 wherein the stringer members further comprise transverse, elongate upper marginal flanges, and wherein the deck member pairs of opposed slot openings are spaced from the ends of the deck members a distance equal to the width of the stringer member upper marginal flanges, so that said deck member ends do not project beyond the stringer member flanges.

5. A pallet as claimed in claim 2 wherein the deck member sides further include longitudinal, generally V-shaped reinforcing portions, said deck member slot openings being partially formed in said reinforcing portions.

6. A pallet as claimed in claim 2 wherein the deck members include central, longitudinal generally V-shaped strengthening ribs, said ribs extending downwardly to engage the lower peripheral edges of the stringer member openings.

7. A pallet as claimed in claim 2 wherein the stringer member sides further include a plurality of spaced-apart stiffening ribs to resist lateral side sway of the stringer members.

8. A pallet as claimed in claim 2 wherein the stringer member sides further define pairs of transverse, four-way entry openings located adjacent to the bottom of the stringer members for insertion of forks of a fork-lift truck.

9. A pallet as claimed in claim 1 and further comprising a third intermediate stringer member spaced between and identical to said pair of stringer members, the deck member sides defining intermediate pairs of parallel slot openings for engagement with peripheral edges of the intermediate stringer member openings.

10. A pallet as claimed in claim 1 and further comprising a pair of lower deck members spaced below and identical to said coplanar deck members, one of said lower deck members being located adjacent to each side of the pallet, the stringer member sides defining transverse openings for insertion of the ends of the lower deck members.

11. A pallet as claimed in claim 3 wherein: the stringer members further comprise transverse, elongate upper marginal flanges, the deck member pairs of opposed slot openings being spaced from the ends of the deck members a distance equal to the width of the stringer member upper marginal flanges, so that said deck member ends do not project beyond the stringer member flanges; the deck member sides further including longitudinal, generally V-shaped reinforcing portions, said deck member slot openings being partially formed in said reinforcing portions; and the deck members including central, longitudinal generally V-shaped strengthening ribs, said ribs extending downwardly to engage the lower peripheral edges of the stringer member openings.

12. A pallet as claimed in claim 1 wherein said deck member slot openings are formed with enlarged lead-in openings to facilitate engagement of the deck member and stringer member sides.

13. A pallet as claimed in claim 6 wherein said V-shaped strengthening ribs have laterally resilient sides, said sides being laterally inwardly deflected upon insertion of the deck members into said stringer member openings.

14. A pallet as claimed in claim 11 wherein said V-shaped strengthening ribs have laterally resilient sides, said sides being laterally inwardly deflected upon insertion of the deck members into said stringer member openings.

* * * * *